US009085923B1

(12) United States Patent
McWhinney

(10) Patent No.: US 9,085,923 B1
(45) Date of Patent: Jul. 21, 2015

(54) PORTABLE DOOR STOP WITH KNOCKER

(71) Applicant: David J. McWhinney, Carlsbad, CA (US)

(72) Inventor: David J. McWhinney, Carlsbad, CA (US)

( * ) Notice: Subject to any disclaimer, the term of this patent is extended or adjusted under 35 U.S.C. 154(b) by 343 days.

(21) Appl. No.: 13/871,923

(22) Filed: Apr. 26, 2013

Related U.S. Application Data

(60) Provisional application No. 61/639,979, filed on Apr. 29, 2012.

(51) Int. Cl.
*E05C 17/54* (2006.01)

(52) U.S. Cl.
CPC ..... *E05C 17/54* (2013.01)

(58) Field of Classification Search
USPC ..... 116/2, 85, 86, 96, 97, 148, DIG. 12; 119/702, 707, 708; D8/401
See application file for complete search history.

(56) References Cited

U.S. PATENT DOCUMENTS 6,557,915 B1 * 5/2003 Duff ..... 292/343

FOREIGN PATENT DOCUMENTS

GB 2478366 A * 9/2011

* cited by examiner

*Primary Examiner* — Daniel S Larkin
*Assistant Examiner* — Irving A Campbell
(74) *Attorney, Agent, or Firm* — Plager Schack LLP

(57) ABSTRACT

Some embodiments provide a door stopper with knocker apparatus for holding open a door. In some embodiments, the door stopper with knocker apparatus comprises a doorstop, a cord, and a knocker. In some embodiments, the door stopper with knocker apparatus is configured to allow an upright person place the doorstop in a position on the ground to hold the door open.

9 Claims, 2 Drawing Sheets

PORTABLE DOOR STOP WITH KNOCKER

CLAIM OF BENEFIT TO PRIOR APPLICATION

This application claims benefit to U.S. Provisional Patent Application 61/639,979, entitled "Door Stopper," filed Apr. 29, 2012. The U.S. Provisional Patent Application 61/639,979 is incorporated herein by reference.

BACKGROUND

Embodiments of the present invention relate to door stoppers and, more particularly, to door stoppers that safely and effectively hold open doors without causing injury to persons or damage to the door, floor, or other physical property.

Certain doors are routinely held open for extended periods of time for a variety of needs. For example, hotel room doors are often propped open by staff cleaning the room for hotel visitors, and service doors in restaurants and other stores are often held open while a delivery person unloads product shipments. However, the very doors that routinely need to be propped open for extended lengths of time are typically very heavy and difficult to hold open. For instance, hotel room doors are usually heavy and often include an automatic closing mechanism that adds counter-force when a person holds the door open. While a variety of door stops are available currently, none are effective at holding doors open without injury. Most of the existing door stops require a person (e.g., a maid cleaning a hotel room) to bend over in order to place the door stop in a crevice between the floor and the door, or between the door and the inner frame. This causes repetitive injuries from repeated bending over, and generally exposes body parts (e.g., fingers and hands) into potentially dangerous areas (e.g., pinch points of the door).

Furthermore, most existing doorstops fail to prevent undue damage to the door, the floor, or other physical property. The existing door stops available to people typically require some form of "torque" in order to make the door stay open. The torque is what causes damage and leads to excessive wear and tear to doors and floors. Other door stoppers do not allow the user to effectively announce the user's own presence before entering a room.

Thus, what is needed is a doorstop that will not cause damage to any surfaces and is made to be deployed in a safe and ergonomically effective manner.

BRIEF SUMMARY

Some embodiments of the invention provide a novel door stopper with knocker apparatus for holding open a door. In some embodiments, the door stopper with knocker apparatus comprises a doorstop, a cord, and a knocker. In some embodiments, the door stopper with knocker apparatus is configured to allow an upright person place the doorstop in a position on the ground to hold the door open.

BRIEF DESCRIPTION OF THE DRAWINGS

Having described the invention in general terms, reference is now made to the accompanying drawings, which are not necessarily drawn to scale, and wherein.

DETAILED DESCRIPTION

In the following detailed description, several examples and embodiments of the invention are described. However, it will be clear to a person skilled in the art that the invention is not limited to the embodiments set forth and can be adapted for any of several other uses.

Some embodiments of the invention provide a novel door stopper with knocker apparatus for holding open a door. In some embodiments, the door stopper with knocker apparatus comprises a doorstop, a cord, and a solid knocker. In some embodiments, the door stopper with knocker apparatus is configured to allow an upright person place the doorstop in a position on the ground to hold the door open.

Figure 1:
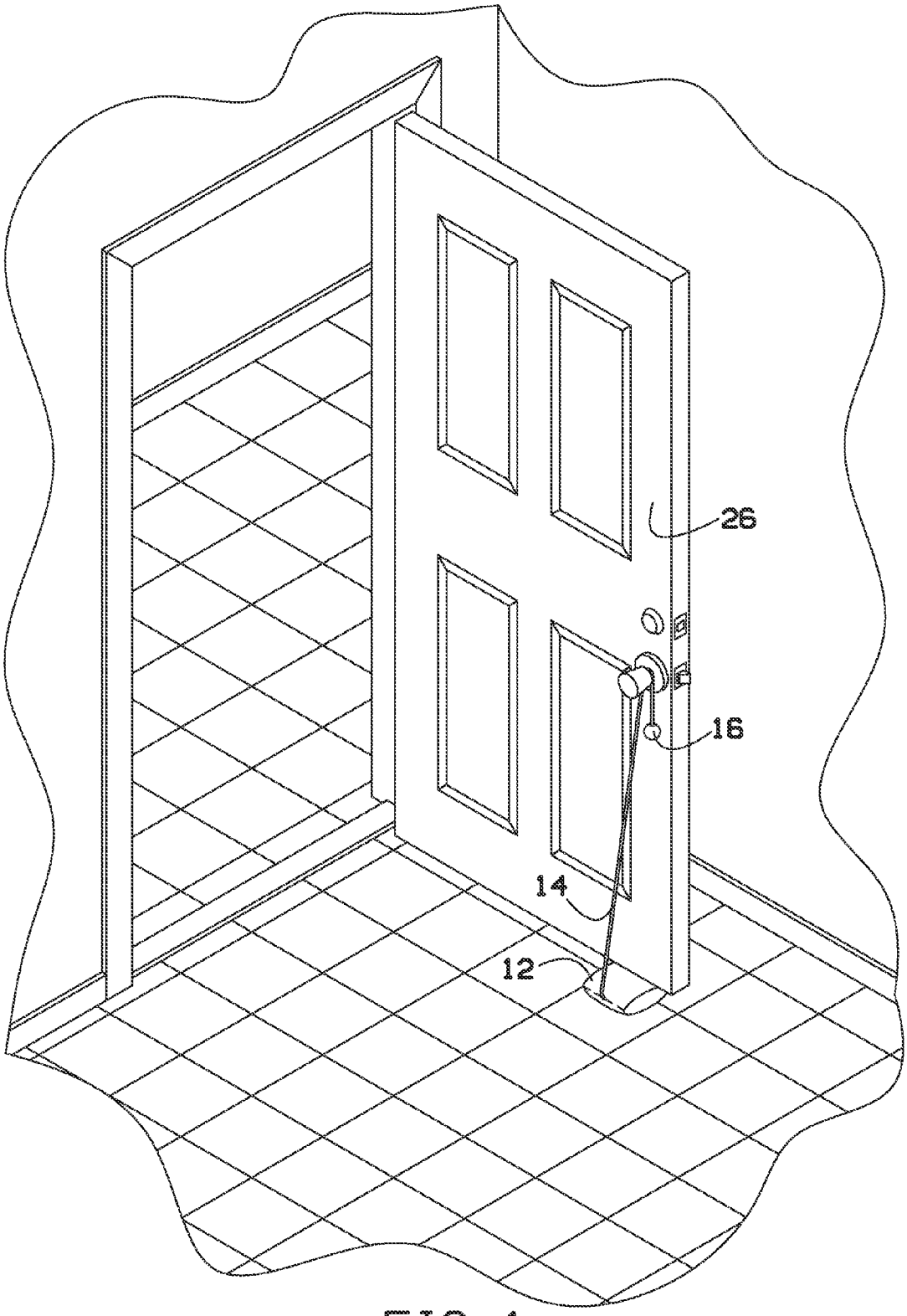
FIG. 1 conceptually illustrates a perspective view of an example door stopper with knocker apparatus of some embodiments while the door stopper is in use.

FIG. 1 conceptually illustrates a perspective view of an example door stopper with knocker apparatus of some embodiments while in use. The door stopper with knocker apparatus shown in this figure is holding open a heavy door 26. As shown, the door stopper with knocker apparatus comprises a doorstop 12, a cord 14, and a solid knocker 16. The cord 14 connects the solid knocker 16 to the doorstop 12. The solid knocker could be secured to the cord by a knot, by crimping, by an aglet, by shrink wrap attachment, etc. Different materials could be used for knocker, such as plastic or wood.

In some embodiments, the door stopper with knocker apparatus works as a single unit to allow a person to announce his or her presence and to hold the door open without requiring the person to bend over to place the door stop. Specifically, the knocker 16 rests over the door handle to let the person easily grab and/or tap the door to announce presence. While the knocker lays over the door handle, the doorstop 12 is positioned under the door in a manner that holds the door open. The person only has to drop the doorstop 12 to the ground and lay the knocker 16 over the door handle in order to hold the door open because the doorstop 12 will catch the door on the ground. When it is time for the door to be closed, a person can simply grab the knocker or the cord and pull the doorstop out from under the door. In this way, the person is never required to bend over or subject body parts, such as fingers and hands, to dangerous pinch points of doors.

Most doorstops are based on a "wedge" shape that requires the door to be pulled in order to secure it to the wedge. Over time, wedge-designed doorstops cause excessive torqueing on the door hinges and damage the face of the door and the flooring where the contact is made. In order to place the doorstop on the ground, most people are required to bend over to put the doorstop in place, which may lead to bending and lifting injuries.

In contrast, the doorstop of some embodiments is designed to effortlessly hold open any door with minimal effort by a user of the doorstop. The only force required of the user is to open the door, lay the knocker over the door handle, drop the doorstop to the floor from a comfortable upright standing position, and release the door. When the door swings back, the doorstop will compress and cause the door to stop when the base of the door catches on the doorstop. Thus, instead of bending and pushing by the user, the main forces at work are gravity and friction.

Figure 2:
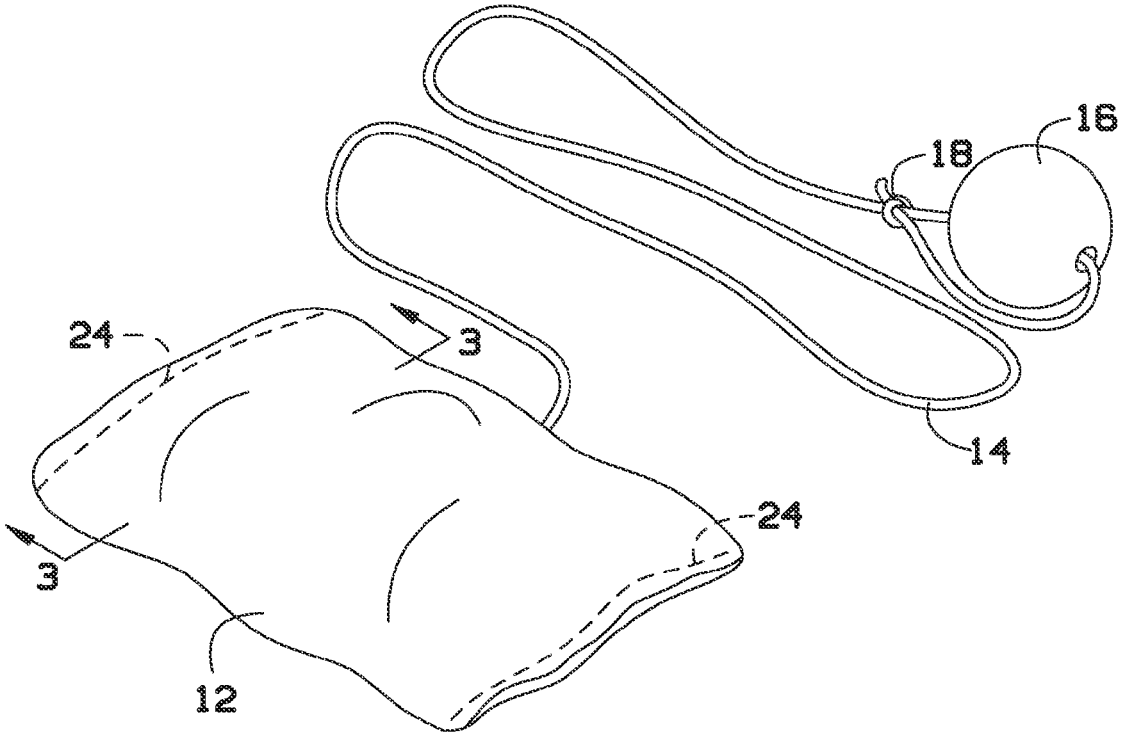
FIG. 2 conceptually illustrates a perspective view of an example door stopper with knocker apparatus of some embodiments.

FIG. 2 conceptually illustrates a perspective view of an example door stopper with knocker apparatus of some embodiments. Specifically, this figure shows a door stopper and knocker apparatus of some embodiments that is designed to hold open even the heaviest doors without causing damage to doors, floors, or other physical property and is safely deployed without bending or placing hands or fingers near dangerous pinch points. As shown the door stopper with knocker apparatus includes the doorstop 12, the cord 14, and the knocker 16. In addition, the door stopper with knocker apparatus includes thread 24 to secure the soft contents inside the doorstop 12, and a knot 18 to secure the knocker 16 to the cord 14.

Figure 3:
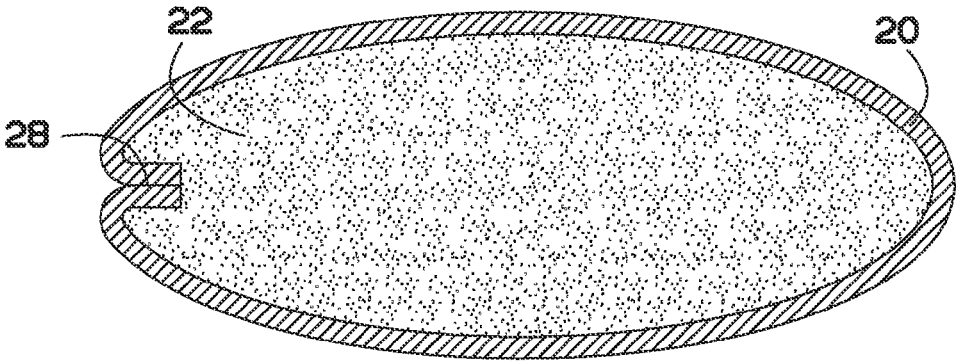
FIG. 3 conceptually illustrates a sectional view along line 3-3 of the example door stopper with knocker apparatus of some embodiments shown in FIG. 2.

In general, the doorstop is designed of soft materials that will not damage any surfaces. The material make-up of the doorstop 12 is shown in FIG. 3, which conceptually illustrates a sectional view along line 3-3 of the example door stopper with knocker apparatus shown in FIG. 2. Specifically, a pouch for the doorstop 12 is made from an outer layer made of neoprene rubber with a nylon backing 20 encapsulates pliable filler material 22 by a seam 28. In some embodiments, the pliable filler material is latex rubber material.

In some embodiments, a magnet could be placed inside the pouch to provide a way to attach the apparatus to metal carts. Furthermore, the cord could be a retractable cord that retracts inside the pouch in some embodiments.

In some embodiments, the neoprene rubber exterior 20 provides the right amount of friction to not slide on any clean dry surface. Specifically, the neoprene cover material provides a coefficient of friction that is sufficient for holding a standard-weight hotel room door in place on any flooring surface (e.g., hardwood, tile, marble, granite, laminate, other synthetic surface flooring, carpeting, etc.). Thus, the door is stopped by the door using its own weight to jamb the doorstop under the door so that it stays open. Thus, a person is not required to bend over and physically push the doorstop under the door (e.g., as is required by wedge-based doorstops).

In some embodiments, the pliable filler material is soft and, therefore, will not damage the door, the floor, or other physical items. The softness allows the doorstop 12 to be squeezed or compressed by a certain amount that varies with the type of filler used. In particular, the latex filler in the doorstop is both flexible and resilient, which allows the doorstop to catch and hold doors using compression and friction rather than any applied force on the part of the user. The flexibility of the latex filler allows the doorstop to work on doors with a varying range of space between the floor surface and the base of the door. The filler is resilient rather than fixed and rigid, which allows it to retain its flexibility after repeated uses and facilitates the ease of passive placement and removal by the user.

Referring back to FIG. 2, the doorstop 12 is configured for easy upright placement by a person. Specifically, the doorstop 12 is lowered into working position via the cord 14 so that no bending is required upon deployment. The doorstop simply gets lowered to the floor and when the door closes, the weight of the door compresses the doorstop 12 to the point of stopping the door (i.e., due to the neoprene outer layer, which prevents sliding of the doorstop).

The doorstop is also easily retrieved after use. In particular, a person can grab the cord and the door handle to retrieve the doorstop. This is essentially the reverse of placement. The user only needs to exert enough force on the door to release the doorstop, which is then retrieved by pulling up the cord, again from a standing position. Thus, no bending is required of the user.

As can be understood, the door stopper with knocker apparatus of some embodiments requires little dynamic force on the part of the user, and relies on passive forces such as gravity and friction for its function. This eliminates physical stresses on the user and decreases the possibility of stress- and contact-related injuries.

The above-described embodiments of the invention are presented for purposes of illustration and not of limitation.

I claim:

1. An ergonomic door stopper apparatus comprising:

a cord;

a knocker for tapping a door to announce a person's presence, the knocker comprising an eyelet through which the cord passes to secure the knocker to a first end of the cord; and a doorstop comprising a pliable filler material and an outer layer that prevents sliding on hard dry floor surfaces, the doorstop secured to the other end of the cord for allowing a person to drop the doorstop to the floor and lay the cord at the knocker end over a handle of an open door, wherein the door gets caught on the doorstop after the door is released.

2. The ergonomic door stopper apparatus of claim 1, wherein the pliable filler material is latex rubber filler material.

3. The ergonomic door stopper apparatus of claim 1, wherein the outer layer comprises a neoprene material.

4. The ergonomic door stopper apparatus of claim 3, wherein the neoprene material provides a coefficient of friction that is sufficient for holding the door in place on any flooring surface.

5. The ergonomic door stopper apparatus of claim 4, wherein the floor comprises at least one of hardwood flooring, tile flooring, laminate flooring, granite flooring, and marble flooring.

6. The ergonomic door stopper apparatus of claim 1, wherein the floor comprises a carpet flooring material.

7. The ergonomic door stopper apparatus of claim 1, wherein the cord is sewn to the outer layer of the doorstop to secure to the doorstop to the cord.

8. The ergonomic door stopper apparatus of claim 1, wherein the knocker is a solid knocker.

9. The ergonomic door stopper apparatus of claim 1, wherein the cord is a retractable cord.

* * * * *